US009879449B2

(12) United States Patent
Philippe et al.

(10) Patent No.: US 9,879,449 B2
(45) Date of Patent: Jan. 30, 2018

(54) VEHICLE LATCH ASSEMBLY AND METHOD OF DAMPENING SOUND DURING A CLOSING PROCESS OF THE VEHICLE LATCH ASSEMBLY

(71) Applicants: Pascal Philippe, Saulcy / Meurthe (FR); Richard Grandjean, Saint Die des Vosges (FR); Michel Noel, Anould (FR); Jean-Bernard Didier, Anould (FR)

(72) Inventors: Pascal Philippe, Saulcy / Meurthe (FR); Richard Grandjean, Saint Die des Vosges (FR); Michel Noel, Anould (FR); Jean-Bernard Didier, Anould (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 0 days.

(21) Appl. No.: 14/147,197

(22) Filed: Jan. 3, 2014

(65) Prior Publication Data

US 2015/0191947 A1 Jul. 9, 2015

(51) Int. Cl.
*E05C 3/06* (2006.01)
*E05B 77/38* (2014.01)
(Continued)

(52) U.S. Cl.
CPC ..... *E05B 77/38* (2013.01); *E05B 85/243* (2013.01); *Y10T 292/1075* (2015.04)

(58) Field of Classification Search
CPC ..... Y10T 292/1043; Y10T 292/1045; Y10T 292/1075; E05C 3/12; E05C 3/01; E05C 3/08; E05C 3/10; E05C 3/16; E05C 3/162; E05C 3/165; E05C 3/167; E05C 3/04; E05C 3/041; E05C 3/042; E05C 3/043; E05C 3/044; E05C 3/045; E05C 3/046; E05C 3/047; E05B 77/38; E05B 85/243; E05B 63/0013
(Continued)

(56) References Cited

U.S. PATENT DOCUMENTS 4,358,141 A * 11/1982 Hamada ..... 292/216
4,756,564 A * 7/1988 Ikeda ..... 292/216
(Continued)

FOREIGN PATENT DOCUMENTS

EP 1724424 B1 11/2006
GB 2379954 A 3/2003

OTHER PUBLICATIONS

French Preliminary Search Report for Application No. FR1463475.
Written Opinion for Application No. FR1463475.

*Primary Examiner* — Kristina R Fulton
*Assistant Examiner* — Faria F Ahmad
(74) *Attorney, Agent, or Firm* — Cantor Colburn LLP

(57) ABSTRACT

A vehicle latch assembly includes a housing having a frame plate. Also included is a claw disposed within the housing and operatively coupled to the frame plate, the claw configured to rotate between an open latch position and a closed latch position. Further included is a claw buffer disposed within the housing and configured to interact with the claw upon rotation to the closed latch position, the claw buffer including at least one abutment portion configured to engage the claw prior to reaching the closed latch position.

7 Claims, 4 Drawing Sheets

(51) Int. Cl.

| | |
|---|---|
| *E05C 3/02* | (2006.01) |
| *E05C 3/04* | (2006.01) |
| *E05C 3/16* | (2006.01) |
| *E05B 85/24* | (2014.01) |

(58) Field of Classification Search
USPC ..... 292/201, 216, DIG. 23, 195, 210
See application file for complete search history.

(56) References Cited

U.S. PATENT DOCUMENTS

| | | | | |
|---|---|---|---|---|
| 5,020,838 | A * | 6/1991 | Fukumoto | 292/201 |
| 5,544,925 | A * | 8/1996 | Ikeda | 292/216 |
| 6,113,161 | A * | 9/2000 | Jung et al. | 292/216 |
| 6,749,234 | B2 * | 6/2004 | Bruce | 292/216 |
| 6,789,825 | B2 * | 9/2004 | Kalargeros et al. | 292/216 |
| 7,195,292 | B2 * | 3/2007 | Ketelsen et al. | 292/216 |
| 7,475,923 | B2 * | 1/2009 | Ottino | E05B 85/26 292/216 |
| 7,503,598 | B2 * | 3/2009 | Graute | 292/216 |
| 7,789,440 | B2 * | 9/2010 | Graute | E05B 85/26 292/216 |
| 7,845,692 | B2 * | 12/2010 | Inan et al. | 292/216 |
| 7,926,858 | B2 * | 4/2011 | Otsuka | 292/216 |
| 8,303,003 | B2 * | 11/2012 | Berghahn et al. | 292/201 |
| 8,888,150 | B2 * | 11/2014 | Nagaoka | 292/341.17 |
| 2002/0000724 | A1 * | 1/2002 | Kalargeros et al. | 292/195 |
| 2003/0222462 | A1 * | 12/2003 | Bruce | E05B 85/26 292/216 |
| 2005/0062295 | A1 * | 3/2005 | Ketelsen et al. | 292/216 |
| 2005/0134054 | A1 * | 6/2005 | Stefanic et al. | 292/201 |
| 2006/0267351 | A1 * | 11/2006 | Spurr | 292/216 |
| 2006/0279090 | A1 * | 12/2006 | Ottino et al. | 292/216 |
| 2007/0007774 | A1 * | 1/2007 | Stefanic | 292/216 |
| 2007/0046035 | A1 * | 3/2007 | Tolley | 292/201 |
| 2007/0205613 | A1 * | 9/2007 | Berghahn et al. | 292/216 |
| 2008/0203737 | A1 * | 8/2008 | Tomaszewski et al. | 292/216 |
| 2008/0303292 | A1 * | 12/2008 | Graute | 292/216 |
| 2009/0021027 | A1 * | 1/2009 | Inan | 292/341.12 |
| 2011/0012376 | A1 * | 1/2011 | Hunt | E05B 85/26 292/216 |
| 2012/0007372 | A1 * | 1/2012 | Nurmi et al. | 292/216 |
| 2012/0061977 | A1 * | 3/2012 | Takeda | 292/201 |
| 2013/0270845 | A1 * | 10/2013 | Nagaoka | 292/341.17 |
| 2014/0210220 | A1 * | 7/2014 | Limberg et al. | 292/216 |
| 2014/0291998 | A1 * | 10/2014 | Pettengill et al. | 292/96 |

* cited by examiner

VEHICLE LATCH ASSEMBLY AND METHOD OF DAMPENING SOUND DURING A CLOSING PROCESS OF THE VEHICLE LATCH ASSEMBLY

BACKGROUND

The subject matter disclosed herein relates to latch assemblies and, more particularly, to an assembly directed at reducing sound associated with a closing process of a latch assembly, as well as a method of dampening sound during such a closing process.

Often, consumers equate the performance and quality of vehicles and vehicle components with sound quality and minimal noise, vibration, and harshness (NVH) characteristics of vehicle components including the latching mechanism of a vehicle door. Providing a vehicle door that opens and closes properly and performs each of those functions with minimal audible indication can suggest to a consumer that the overall door assembly, the door closing mechanism, and the vehicle are of high quality.

Door latch assemblies typically include multiple metallic components and the interaction of these components during latch operation may contribute to noise that is unpleasant to the consumer. Therefore, a reduction in generated noise is desired. Efforts to reduce noise associated with latch operation often lead to a requirement of a greater force from the user to effectively complete the opening and/or closing process. This is a trade-off to reduce noise, but such an effect is also undesirable to a user. Therefore, balancing noise reduction and closing/opening effort is a challenge associated with latch manufacturing.

SUMMARY

According to one embodiment, a vehicle latch assembly includes a housing having a frame plate. Also included is a claw disposed within the housing and operatively coupled to the frame plate, the claw configured to rotate between an open latch position and a closed latch position. Further included is a claw buffer disposed within the housing and configured to interact with the claw upon rotation to the closed latch position, the claw buffer including at least one abutment portion configured to engage the claw prior to reaching the closed latch position.

According to another embodiment, a method of dampening sound during a closing process of a vehicle latch assembly is provided. The method includes rotating a claw from an open latch position to a closed latch position. The method also includes dampening the sound associated with rotation of the claw to the closed latch position by contacting a portion of the claw with a claw buffer prior to full rotation of the claw to the closed latch position.

According to yet another embodiment, a vehicle latch assembly includes a frame plate. Also included is a claw operatively coupled to the frame plate, the claw configured to rotate between an open latch position and a closed latch position. Further included is a claw buffer joined to the frame plate. The claw buffer includes a leg formed of an elastic material, the leg having a first abutment surface positioned to be contacted by the claw prior to rotation of the claw to the closed latch position. The claw buffer also includes a second abutment surface, wherein the claw is configured to contact the first abutment surface of the leg to maneuver the leg and the claw into contact with the second abutment surface in an over-stroke position relative to the closed latch position, and wherein the second abutment surface is formed of a material having a rigidity greater than the rigidity of the first abutment surface.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Referring now to the figures, which are exemplary embodiments, and wherein like elements are numbered alike.

The detailed description explains embodiments of the invention, together with advantages and features, by way of example with reference to the drawings.

DETAILED DESCRIPTION OF THE INVENTION

Figure 1:
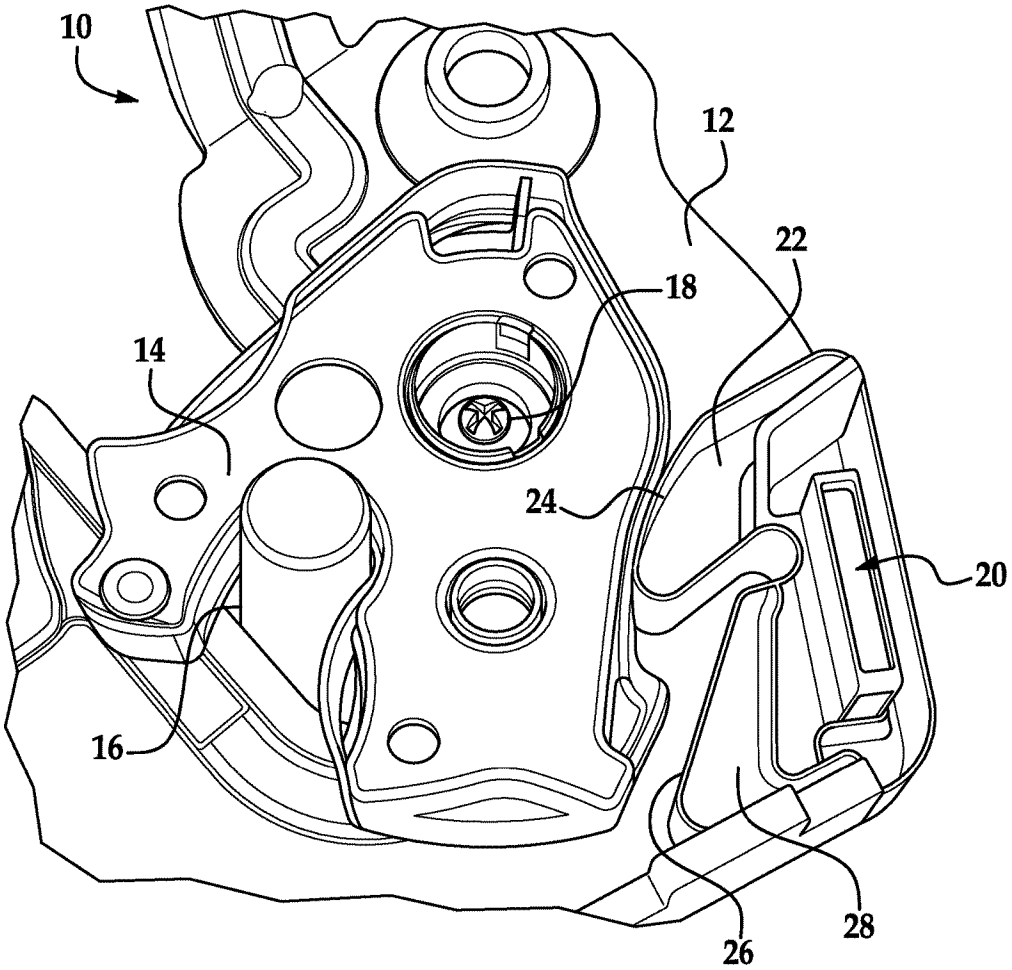
FIG. 1 is a partial perspective view of a vehicle latch assembly according to a first embodiment.
Figure 2:
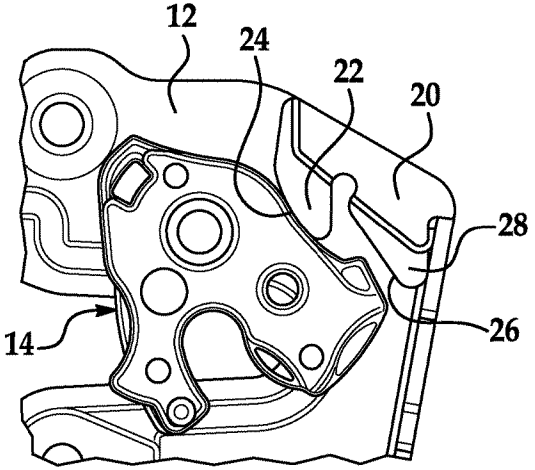
FIG. 2 is an elevational view of the vehicle latch assembly of FIG. 1 in a first position of a closing sequence.

Referring now to FIG. 1, the reference numeral 10 generally designates a vehicle latch assembly according to a first embodiment. The vehicle latch assembly 10 is generally designed for use on a vehicle (not illustrated) having a vehicle door with a door handle. The vehicle latch assembly 10 may be installed on the driver side door, passenger side door, or rear passenger doors. Additionally, the vehicle latch assembly 10 may be installed in alternative locations of the vehicle, such as a vehicle door opening on the B-pillar or may be used in conjunction with a rear door of the vehicle, such as a liftgate, trunk or tailgate, for example.

The vehicle latch assembly 10 includes a housing (not illustrated) behind a frame plate 12 that helps protect the vehicle latch assembly 10 from damage, as well as dirt and debris. The housing is mounted to the vehicle door, such as with a plurality of mechanical fasteners or welding, for example. A rotatable claw 14 releasably retains a striker 16 to hold the door (or liftgate, trunk, tailgate, etc.) in a closed position. The claw 14 is held in the closed position by a pawl (not illustrated). The pawl is actuated to disengage from the claw 14, thereby allowing the claw 14 to be released and biased toward an open position. This operation releases the striker 16 from the claw 14 and facilitates an opening of the vehicle door.

The claw 14 is at least partially disposed within the housing, but is omitted from the illustration for purposes of clarity and description. The claw 14 is operatively coupled to, and retained between, the frame plate 12 and a back plate. The frame plate 12 is shown in the illustrated embodiment. The claw 14 is pivotable about an axis 18 and rotatable between an open latch position and a closed latch position. The claw 14 is shown in a nearly closed latch position. As will be described in detail below, as the claw 14 is rotated toward the closed latch position, the claw 14 comes into close proximity with one or components that may contact the claw 14, thereby generating an audible sound that may be unpleasant to a user. Furthermore, as the claw 14 comes to an abrupt stop when reaching the closed latch position, vibration of the claw 14 may occur which may also be a source of undesirable noise.

To reduce the level of sound associated with the closing process, a claw buffer 20 is included and configured to interact with the claw 14 upon rotation of the claw 14 to the closed latch position. The claw buffer 20 may be operatively coupled to, or integrally formed with, numerous contemplated components. In the illustrated embodiment, the claw buffer 20 is joined with the frame plate 12, but it is to be appreciated that the claw buffer 20 may be joined with the housing or the back plate, for example. Irrespective of the precise component to which the claw buffer 20 is joined, the claw buffer 20 includes a leg 22 extending angularly and outwardly toward the claw 14. The leg 22 is formed of a resilient material that facilitates movement and or elastic deformation of the leg 22 upon being contacted by the claw 14 during the closing process. In particular, the leg 22 includes a first abutment surface 24 configured to be contacted by the claw 14 prior to rotation of the claw 14 to a fully closed latch position. In one embodiment, the leg 22 is formed of an elastic material that enables the resilient movement characteristics noted above. The claw buffer 20 also includes a second abutment surface 26 that is part of a substantially rigid or semi-rigid portion 28 of the claw buffer 20. Regardless of the precise materials employed as the leg 22 and the rigid or semi-rigid portion 28 of the claw buffer 20, it is to be understood that the second abutment surface 26 is formed of a material having rigidity greater than the rigidity of the first abutment surface 24.

Referring now to FIGS. 2-5, various positions of a closing sequence of the vehicle latch assembly 10 are illustrated. In a first illustrated position (FIG. 2), the claw 14 engages the first abutment surface 24 of the leg 22 prior to contacting the second abutment surface 26. Additionally, contact between the claw 14 and the first abutment surface 24 occurs prior to the claw 14 achieving the fully closed (i.e., locked) position. A fully locked position of the vehicle latch assembly 10 is also defined by what may be referred to as its "S point." In this position, the striker 16 is at the end of its travel near the closed end of a throat. Engagement of the claw 14 with the first abutment surface 24 prior to a fully closed position (e.g., "S point") facilitates dampening of the noise associated with the closing process due to the sound dampening characteristics of the elastic material of the leg 22. In one embodiment, the leg 22 is positioned such that contact between the claw 14 and the first abutment surface 24 occurs about 1 millimeter prior to the S point. A hard stop with a leg formed of a more rigid material would require a user to expend a greater amount of effort to fully close the latch. As such, the resilient nature of the leg 22 allows for a reduction in required closing force, while also dampening the noise associated with the closing process.

Figure 3:
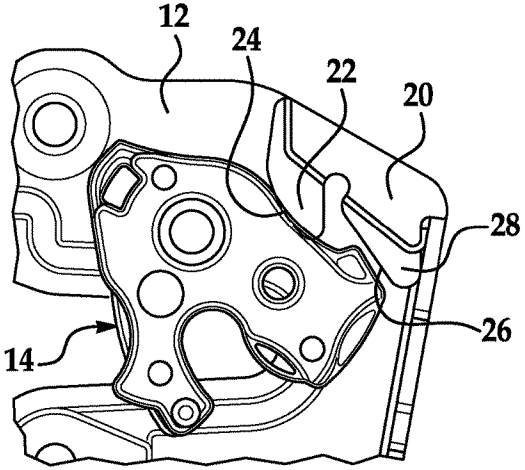
FIG. 3 is an elevational view of the vehicle latch assembly of FIG. 1 in a second position of the closing sequence.
Figure 4:
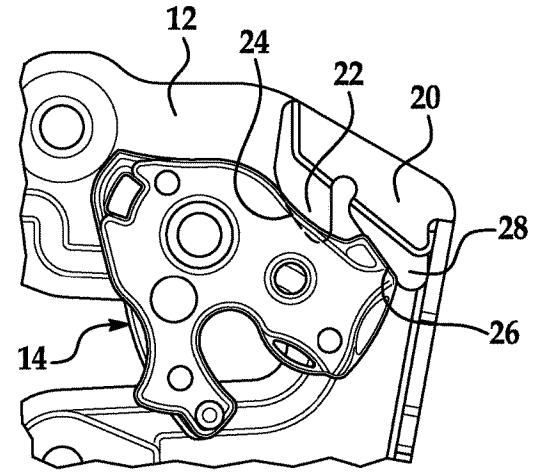
FIG. 4 is an elevational view of the vehicle latch assembly of FIG. 1 in a third position of the closing sequence.
Figure 5:
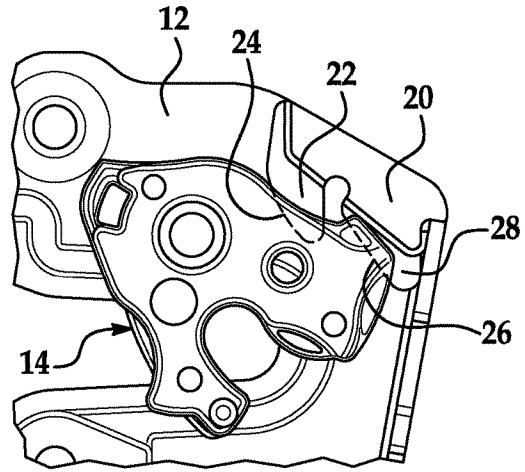
FIG. 5 is an elevational view of the vehicle latch assembly of FIG. 1 in a fourth position of the closing sequence.

As the claw 14 continues rotation into and through the fully closed latch position, the leg 22 flexes and/or deforms (FIG. 3). Subsequently, the claw 14 rotates through the S point into what is referred to as an "over-stroke" condition (FIG. 4) and the claw 14 contacts the second abutment surface 26 of the claw buffer 20. In one embodiment, contact between the claw 14 and the second abutment surface 26 occurs at about 1 millimeter past the S point. Finally, the claw 14 is rotated to a maximum over-stroke position (FIG. 5) and the leg 22 is fully compressed due to the continued rotation of the claw 14. Although not illustrated as such, the leg 22 may be compressed to the extent that the leg 22 contacts the second abutment surface 26. In one embodiment, the maximum over-stroke position of the claw 14 is about 3 millimeters past the S point, but this is adjustable and alternative maximum over-stroke positions are contemplated.

Figure 6:
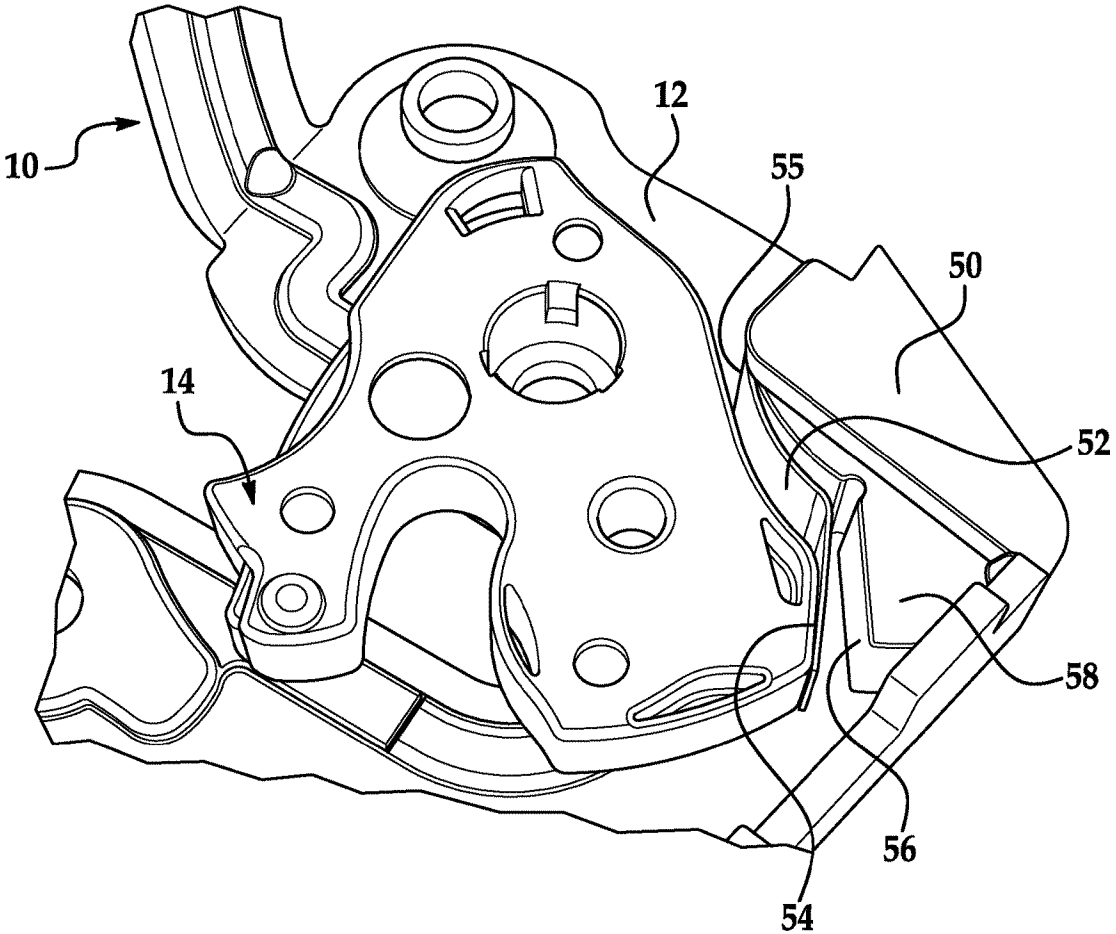
FIG. 6 is a partial perspective view of the vehicle latch assembly according to a second embodiment.
Figure 7:
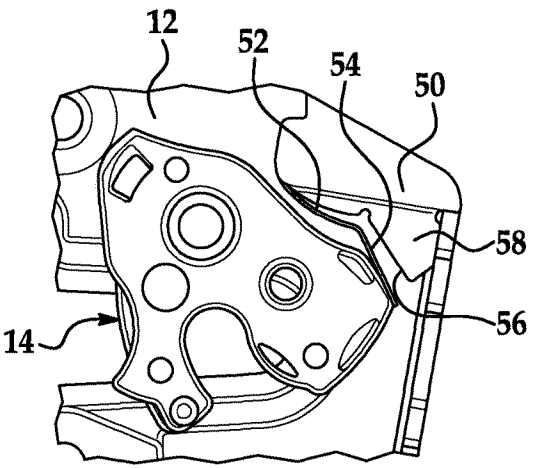
FIG. 7 is an elevational view of the vehicle latch assembly of FIG. 6 in a first position of a closing sequence.

Referring to FIG. 6, a second embodiment of the vehicle latch assembly 10 is illustrated. More particularly, a second embodiment of the claw buffer is shown. The claw buffer of the second embodiment is referred to with reference numeral 50. The second embodiment of the overall vehicle latch assembly 10 is similar in many respects to the first embodiment, such that duplicative description of numerous components is not necessary. Additionally, where applicable, similar reference numerals are employed.

In the illustrated embodiment, the claw buffer 50 includes a leg 52 having an abutment surface 54. The leg 52 is formed of a resilient metal that is configured to rotate substantially about a point 55. In one embodiment the resilient metal comprises a spring steel that allows the leg 52 to be rotatable, while also resiliently recovering an initial position when a load is not imparted upon it.

Referring now to FIGS. 7-10, various positions of a closing sequence of the vehicle latch assembly 10 according to the second embodiment are illustrated. In a first illustrated position (FIG. 7), the claw 14 engages the first abutment surface 54 of the leg 52 prior to the claw 14 achieving the fully closed (i.e., locked) position defined by the S point described above. Engagement of the claw 14 with the first abutment surface 54 prior to a fully closed position (e.g., "S point") facilitates dampening of the noise associated with the closing process due to the sound dampening characteristics of the elastic material of the leg 52. In one embodiment, the leg 52 is positioned such that contact between the claw 14 and the first abutment surface 54 occurs about 1 millimeter prior to the S point. As described above, a hard stop with a leg formed of a more rigid material would require a user to expend a greater amount of effort to fully close the latch. As such, the resilient nature of the leg 52 allows for a reduction in required closing force, while also dampening the noise associated with the closing process.

Figure 8:
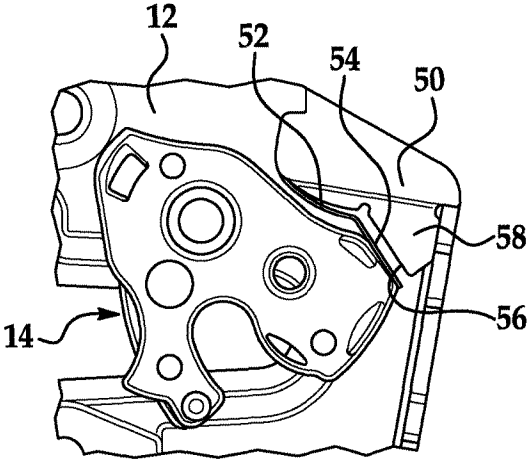
FIG. 8 is an elevational view of the vehicle latch assembly of FIG. 6 in a second position of the closing sequence.
Figure 9:
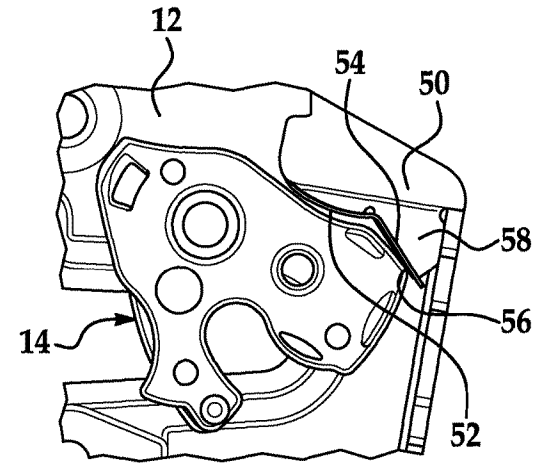
FIG. 9 is an elevational view of the vehicle latch assembly of FIG. 6 in a third position of the closing sequence.
Figure 10:
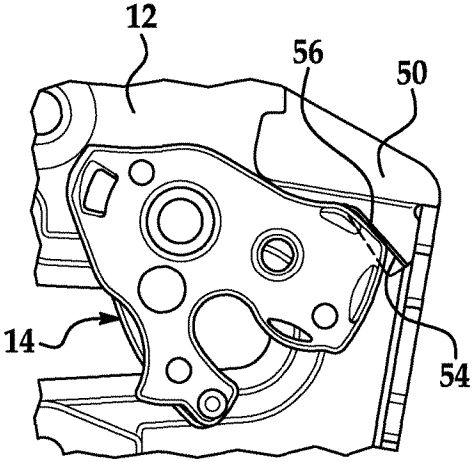
FIG. 10 is an elevational view of the vehicle latch assembly of FIG. 6 in a fourth position of the closing sequence.

As the claw 14 continues rotation into and through the fully closed latch position, the leg 52 rotates (FIG. 8). Subsequently, the claw 14 rotates through the S point into what is referred to as an "over-stroke" condition (FIG. 9) and the claw 14 indirectly contacts a second abutment surface 56 a substantially rigid or semi-rigid portion 28 of a the claw buffer 20 upon contact of the leg 52 with the second abutment surface 56. In one embodiment, contact between the claw 14 and the second abutment surface 56 occurs at about 1 millimeter past the S point. Finally, the claw 14 is rotated to a maximum over-stroke position (FIG. 10) and the leg 52 is fully compressed due to the continued rotation of the claw 14. In one embodiment, the maximum over-stroke position of the claw 14 is about 3 millimeters past the S point, but this is adjustable and alternative maximum over-stroke positions are contemplated.

The above-described embodiments maintain vehicle door operability, while minimizing noise associated therewith. This reduction in noise appeals to consumers and allows continued optimal opening and closing operation of the vehicle door. Additionally, the force required by a user to complete the latch closing process is reduced by incorporating a progressive buffer in the form of the legs 22, 52 of the above-described embodiments, while maintaining the sound dampening characteristics of the overall vehicle latch assembly 10.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A vehicle latch assembly comprising:

a housing having a frame plate;

a claw disposed within the housing and operatively coupled to the frame plate, the claw configured to rotate between an open latch position and a closed latch position; and a claw buffer secured to the housing and configured to reduce audible noises of the latch assembly associated with the movement of the claw into the closed latch position, wherein the claw buffer has a first abutment portion configured to engage the claw prior to the closed latch position and be deflected away from the claw as the claw rotates towards the closed latch position and a second abutment portion configured to be contacted by the claw as it rotates past the closed latch position, wherein the first abutment portion is a leg member extending away from the claw buffer, wherein the second abutment portion is formed of a material having a greater rigidity than that of the first abutment portion and wherein the first abutment portion is contacted by the claw before the second abutment portion is contacted by the claw;

wherein the leg is a resilient member configured to be maneuvered into contact with the second abutment portion when the claw rotates past the closed latch position.

2. The vehicle latch assembly of claim 1, wherein the leg is formed of an elastic material.

3. The vehicle latch assembly of claim 1, wherein the leg is formed of spring steel.

4. The vehicle latch assembly of claim 1, wherein the claw contacts the second abutment portion in an over-stroke position relative to the closed latch position.

5. A vehicle latch assembly comprising:

a frame plate;

a claw operatively coupled to the frame plate, the claw configured to rotate between an open latch position and a closed latch position; and a claw buffer joined to the frame plate, the claw buffer being configured to reduce audible noises of the latch assembly associated with the movement of the claw into the closed latch position, the claw buffer comprising:

a leg formed of an elastic material, the leg having a first abutment surface positioned to be contacted by the claw prior to rotation of the claw to the closed latch position; and a second abutment surface, wherein the claw is configured to contact the first abutment surface of the leg and maneuvers the leg into contact with the second abutment surface when the claw is in an over-stroke position relative to the closed latch position, and wherein the second abutment surface is formed of a material having a rigidity greater than the rigidity of the first abutment surface.

6. The vehicle latch assembly of claim 5, wherein the leg is formed of an elastic material.

7. The vehicle latch assembly of claim 5, wherein the leg is formed of spring steel.

* * * * *